United States Patent [19]

Volpenhein

[11] Patent Number: 4,589,241

[45] Date of Patent: May 20, 1986

[54] WALL CONSTRUCTION

[75] Inventor: Carl X. Volpenhein, Covington, Ky.

[73] Assignee: American Siding Discount Distributor, Inc., Cincinnati, Ohio

[21] Appl. No.: 537,286

[22] Filed: Sep. 29, 1983

[51] Int. Cl.[4] ..... E04F 13/08

[52] U.S. Cl. ..... 52/315; 52/385

[58] Field of Search ..... 52/314, 315, 384, 385, 52/386

[56] References Cited

U.S. PATENT DOCUMENTS

| | | | |
|---|---|---|---|
| 1,889,091 | 11/1932 | Fried | 52/385 |
| 2,223,721 | 12/1940 | Ernstoff | 52/385 |
| 2,595,142 | 4/1952 | Herck . | |
| 2,852,932 | 9/1958 | Cable | 52/385 |
| 3,004,369 | 10/1961 | Findlay . | |
| 3,131,514 | 5/1964 | Siek | 52/384 |
| 3,177,279 | 4/1965 | Bilodeau . | |
| 3,518,799 | 7/1970 | Bachner . | |
| 3,872,199 | 3/1975 | Ottinger . | |
| 3,882,218 | 5/1975 | Bixel, Jr. . | |
| 4,079,554 | 3/1978 | Terwilliger | 52/100 |
| 4,241,554 | 12/1980 | Infantino . | |
| 4,290,248 | 9/1981 | Kemerer et al. . | |
| 4,299,069 | 11/1981 | Neumann . | |
| 4,407,104 | 10/1983 | Francis | 52/309.4 |

FOREIGN PATENT DOCUMENTS

| | | | |
|---|---|---|---|
| 2644807 | 4/1978 | Fed. Rep. of Germany . | |
| 2753501 | 6/1979 | Fed. Rep. of Germany | 52/386 |
| 1581355 | 12/1980 | United Kingdom | 52/384 |

OTHER PUBLICATIONS

R-Brick Panel System's brochure RBPS-811 entitled The Brick That Insulates.

R-Brick Panel System's brochure RBPS-812 entitled Technical Data.

*Primary Examiner*—Carl D. Friedman

*Attorney, Agent, or Firm*—Frost & Jacobs

[57] ABSTRACT

A wall construction adapted for rapid on site erection of a wall of modular facing components, such as brick or tile includes a panel member having preformed cavities. The facing components may be inserted into aligned and spaced relationship in the cavities and joined by a bonding agent such as mortar or grout.

12 Claims, 10 Drawing Figures

WALL CONSTRUCTION

TECHNICAL FIELD

The present invention relates generally to building construction and more specifically concerns a highly efficiently constructed wall. The invention will be specifically illustrated in connection with a novel wall construction wherein brick or ceramic tile may be easily and rapidly inserted into preformed cavities of a panel member to erect a wall without the necessity of highly skilled labor.

BACKGROUND OF THE INVENTION

One of the most popular materials for the construction of walls used in contempory buildings is kiln-fired brick. In addition to its strong aesthetic appeal, brick has proved to be a durable, long lasting and maintaince free material, suitable for both interior and exterior walls. Unfortunately, conventional brick wall construction requires substantial time and highly skilled labor for erection. In conventional brick construction, a highly skilled brick layer is required to individually align and secure each individual brick upon a layer of carefully applied mortor. Since the typical brick is relatively small (a typical construction brick is in order of 8 in.×2¼ in.×4 in.), any sizable brick wall construction requires considerable time, even for a highly skilled brick layer.

In recent years, the time and relatively high cost of conventional brick construction has lead to the use of face-brick veneer panel sliding construction. In the typical face-brick veneer siding panel, a plurality of face-brick veneer components, typically of ½ inch in thickness, are secured by an adhesive in aligned relationship onto a panel board of polystyrene at a factory. The panel board is typically in the order of 48 inches by 16½ inches in size, with the brick faces being rigidly secured to a planar side of the panel by an adhesive. During erection, the panel board is installed as a single unit with the brick faces secured thereto. A steel angle is first installed at the bottom of a wall to which the face-brick veneer is to be secured. Bottom panels are then supported on the steel angle along the entire length of the proposed wall with successive panels being supported on their immediate subjacent panel. The top of each of the panels are secured to the wall by a metal clip. Once installation of the brick-faced veneer siding is completed, a mortor machine is used to apply mortor between the brick faces, resulting in an appearance which is virtually indistinguishable from conventional brick construction.

Prior art brick veneer panel construction has not been without its disadvantages, however. During the process of securing the brick faces to the panel board at the factory, it is necessary to lay the panels and the brick faces flat and undisturbed in aligned relationship with the board and each other until the adhesive dries, a process which may take several days. Thereafter, the resulting brick faced panel is relatively heavy (the typical panel has approximately 36 brick faces) and thus difficult to handle manually and expensive to transport. Moreover, during installation of this brick face siding, the substantial weight of the brick faces on the board reduces working efficiency during erection. Furthermore, due to the weight of the brick material and the bending moment exerted on the adhesive interface between the brick and the panel, it has not feasible to adhesively secure standard full size brick (4 inches in thickness) to a panel according to prior art methods. The resulting inavailability of standard full size brick has significantly reduced the marketability of brick-faced veneer construction as many consumers have a strong preference for full size bricks.

SUMMARY OF THE INVENTION

Accordingly, it is a primary object of the present invention to provide a building wall construction which may be efficiently installed at the building location.

It is another object of the present invention to provide a building wall construction which does not require skilled labor for installation and erection.

It is a further object of the invention to provide building components for a wall construction which may be easily and inexpensively transported to a building location.

Another object of the invention is to provide lightweight building components which may be quickly installed to form a brick or tile wall.

Yet another object of the invention is to provide a brick or tile wall wherein the building components are precisely aligned.

A still further object object of the present invention is to provide brick panel using standard full sized kiln-fired brick.

Another object of the present invention is to provide a wall panel with significant thermal insulation.

Still another object of the invention is to provide a panel wall construction wherein the end user may select the desired bricks or tiles from a source independent of the panel and near the building location.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved building construction is provided. The building construction includes a panel member having first and second sides. Means are also provided for securing the panel member onto a building structure in an upright position. The panel includes a plurality of spaced and aligned cavities opened to at least the first side of the panel, said cavities being of substantially uniform size and dimension. A plurality of modular facing components are insertable into and supportable by said cavities.

In another aspect of the invention, the building construction including at least one additional panel and means for interlocking adjacent panel members in substantially planar relationship are provided.

In one specific aspect of the invention, the building construction cavities in the panel member have five joining planar surfaces.

In another specific aspect of the invention, the means for interlocking adjacent panel members includes a tongue and groove arrangement about the periphery of each of the panel members.

In still another aspect of the invention, at least one of the panel members is formed of polystyrene plastic.

In yet another aspect of the invention, the modular facing component is formed of kiln-fired brick.

In an alternative aspect of the invention, the modular facing component is formed of ceramic tile.

In still another aspect of the invention, the cavities are approximately 8 inches in length and 2¼ inches in height.

In yet another specific aspect of the invention, the cavities are approximately 2 inches in depth.

A still further aspect of the invention includes resilient ridges extending into said cavities, said cavities being deformable by the facing component as the facing component is inserted into the cavity for insuring a friction fit between the facing component and the panel member for facing components of slightly varying dimension.

In a still further specific aspect of the invention, a double sided adhesive strip is disposed between said facing component and said panel member for securing said elements together.

In an alternative specific aspect of the invention, an adhesive is disposed between said facing component and said panel member for securing the elements together.

In another aspect of the invention, a method of erecting a wall is provided. The method includes erecting a panel member having a plurality of spaced and aligned modular cavities opened to at least one side of the panel member into an upright position. The upright member is then secured onto a building structure. Modular facing components having dimensions approximately corresponding to the dimensions of the cavity are then inserted into the cavities, and a bonding compound is applied onto the panel member in the spaces between facing components to substantially completely cover the side of the panel member and to secure the facing components in the cavities.

The method may also include the step of securing an additional panel member adjacent to the panel member in interlocking relationship.

In a specific aspect of the method, the panel member is supported on a metal starter strip.

In an alternative method, the panel member is supported on a footer ledge without the interposition of a metal strip.

The method may also include the step of adhesively securing the facing components into the cavities.

Still other objects of the present invention will become apparent to those skilled in this art from the following description wherein there is disclosed and described a preferred embodiment of this invention, simply by way of illustration, of one of the best modes contemplated for carrying out the invention. As will be realized, the invention is capable of other different embodiments, and its several details are capable of modification in various, obvious aspects, all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present invention, an example of which is illustrated in the accompanying drawings.

DETAILED DESCRIPTION OF THE PREFERRED EMBODIMENT

Figures 1, 2, 3:
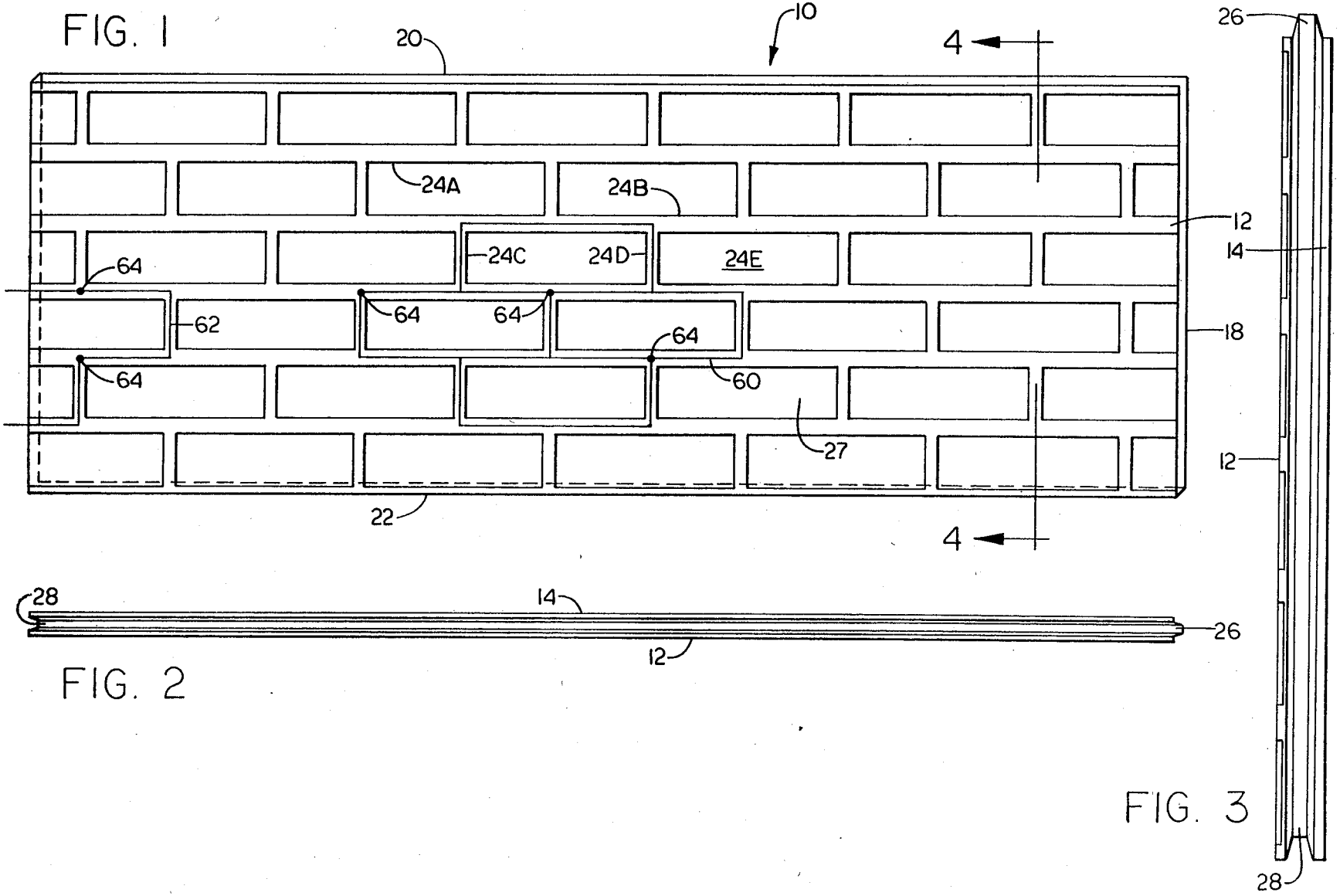
FIG. 1 is a side elevational view of a polystyrene panel member constructed in accordance with the invention depicting spaced and aligned cavities adapted to receive kiln-fired brick facing components.
FIG. 2 is a plan view of the panel member of FIG. 1 illustrating the tongue and groove configuration of the periphery used to interlock the panel member with a similar panel member.
FIG. 3 is an enlarged end elevational view of the panel member of FIGS. 1 and 2 showing both the brick receiving cavities and the tongue and groove configuration.

Referring now to the drawings, and to FIGS. 1–3 in particular, there is shown a panel member 10 of generally rectangular configuration formed in accordance with the principles of the present invention. The panel member 10 includes a first and second planar faces 12 and 14 (face 14 is illustrated in FIGS. 2 and 3), which faces 12 and 14 extends horizontally in parallel relationship between panel ends 16 and 18 and vertically between panel top 20 and panel bottom 22. The panel 10 includes a plurality of spaced and aligned cavities 24 open to the first side 12 and extending into the panel member 10.

As realized from a joint viewing of FIGS. 1 and 3, each of the illustrated cavities 24 has five planar sides. The top and bottom cavity sides **24*a* and 24*b* respectively of cavities 24 are in substantially parallel relationship with other and with the the panel top and bottom 20 and 22 respectively. The ends 24*c* and 24*d* of cavities 24 are in parallel relationship with each other and with the panel ends 16 and 18 respectively. The remaining cavity side 24*e* is parallel to the faces 12 and 14 and in mutually perpendicular relationship with the other cavity sides 24*a*,24*b* and 24*c*,24. In one of the preferred embodiments of the invention, the top and bottom cavity sides 24***a* and 24*b* are approximately 8 inches in length and the cavity ends 24*c* and 24*d* are approximately two and one quarter inches in height. Preferably, the panel member is formed of foamed polystyrene (other alternative materials may also be used), which as will be explained below, provides structural support and thermal insulation.

As seen most clearly in FIGS. 2 and 3, the panel member 10 includes a tongue 26 extending outwardly from the periphery of the top and right (as illustrated in FIG. 1) sides. A groove 28 extends into the peripheral left and bottom (again, as illustrated in FIG. 1) sides of the panel member 10 and is adapted to receive and interlock with a tongue of an adjacent panel member 10 in a matter more fully explained hereinafter.

Figure 4:
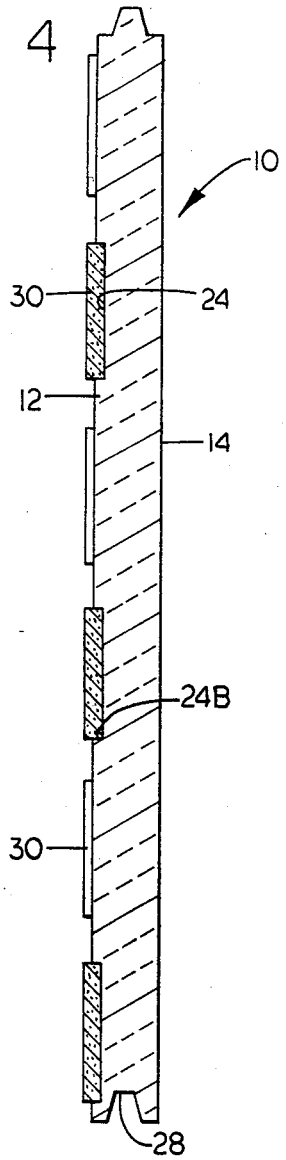
FIG. 4 is a cross-sectional elevational view of the panel member of FIG. 1 showing brick faces disposed in the aligned and spaced cavities.

Turning now to FIG. 4, the panel member 10 is illustrated in cross section with facing components 30 disposed in the cavities 24. The illustrated facing components 30 of FIG. 4 represent either thin (approximately one-half inch in thickness) kiln-fired brick face or ceramic tiles. It will be seen that the facing components 30 extend outwardly from the planar face 12 of the panel member 10 when the facing components 30 are fully inserted in the cavity 24. In the preferred form of the invention, the facing components 30 are of standard size and the cavities 24 are dimensioned in close correspondency to the facing components 30 so as to create a friction fit between the facing component 30 and the panel member 10. This friction fit is then used to secure the facing component 30 into this inserted position illustrated. The weight of the facing component 30 is partially supported by the bottom 24*b* of cavity 24 when the facing component 30 is inserted.

Figure 5:
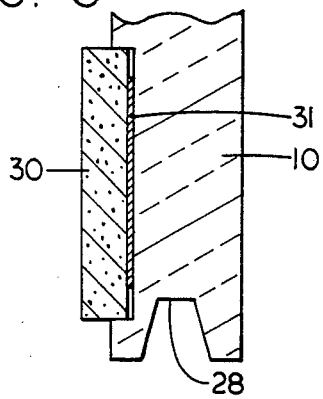
FIG. 5 is an enlarged fragmentary cross-sectional view of the panel of FIG. 4 depicting double sided tape disposed along the brick-panel member interface for securing the brick in the cavity.
Figure 5A:
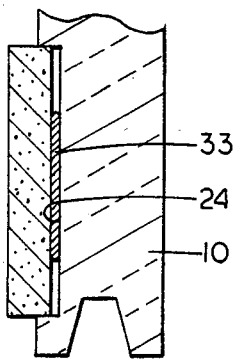
FIG. 5A is an enlarged fragmentary cross-sectional view similar to FIG. 5., but depicting the use of a liquid adhesive to assist in securing the brick in the cavity.

In some circumstances, it may be desirable to augment the friction fit between the facing component 30 and the panel member 10 and to more securely position the facing component 30 in the cavity. In FIG. 5, a double sided adhesive tape 31 is shown disposed at the interface of these elements (10,30). Such double sided tape 31 is commercially available and may be quickly applied to the facing components 30 imediately prior to insertion into the cavities 24. An alternate method of supplementing the the securement forces holding the facing components 30 in cavities 24 is illustrated in FIG. 5A wherein a liquid adhesive 33 has been applied to the interface of the facing component 30 and the cavity 24.

Figure 4A:
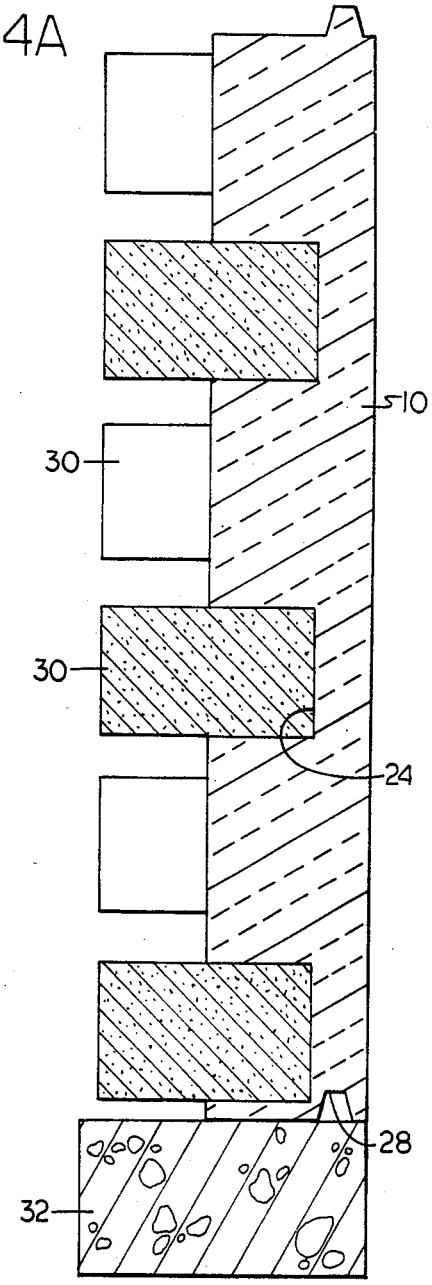
FIGS. 4A is a cross-sectional elevational view of a panel member with bricks secured in the aligned and spaced cavities similar to the depiction of FIG. 4, but illustrating a commercial grade panel member with full size standard kiln-fired brick of 4 inch thickness, and further depicting the panel member being supported upon a footer ledge.

As noted above, the illustration of FIG. 4 depicts a relatively thin facing component 30, such as ceramic tile or brick of one half inch thickness. Brick of this thickness is commonly used in comtempory construction by simply gluing the brick onto a planar panel with the disadvantages noted above. However, prior art methods and structures have been able to accommodate standard full size brick. As seen from the illustration of FIG. 4A, the present invention may also be used with standard size brick facing components. Such standard size bricks have substantially the same length and height as the face-brick secured to prior art panels but are approximately 4 inches in thickness. In order to accommodate these larger facing components, a commercial grade panel member 10 of increased thickness is used. As further illustrated in FIG. 4A, this commercial grade panel member 10 may be supported directly on a footer ledge 32 when the present invention is used in new construction.

Figure 6:
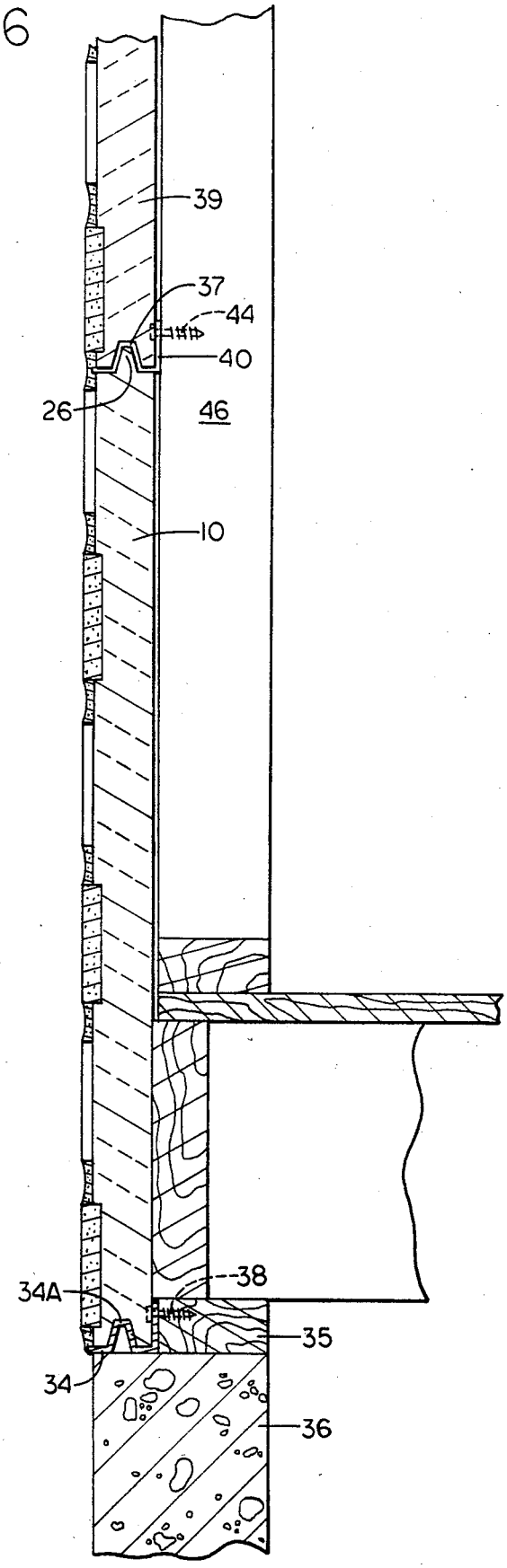
FIG. 6 is a cross-sectional elevational view of a panel member having brick inserts according to the present invention and applied to the framing of a new building construction.

The panel member 10 of FIG. 4 is illustrated following erection in FIG. 6. In contrast to the wall assembly of FIG. 4A, the erected panel member of FIG. 6 is supported upon an angular metal starter strip 34 having a centrally disposed tongue 34*a*.. The metal starter strip 34 is, in turn, supported upon a footer ledge 36. In addition, the illustrated metal starter strip 32 is secured to a 2×4 support 35 securely positioned upon the footer ledge 36. A fastening element, specifically illustrated as a screw 38, is used to fasten the metal starter strip 34 to the 2×4 support 35.

FIG. 6 also illustrates the manner in which the tongue and groove components (26 and 28 respectively) of the panel members 10 are used to interlock adjacent panel members. For purposes of describing FIG. 6, the uppermost of the two illustrated panels, which will be identified by the number 39 to distinguish from the lower panel member, identified by the number 10. The uppermost panel member 39 has a groove 37 on the lower side receiving the tongue 26 of the subjacent panel member 10. Although not specially illustrated, the tongue 26 also extents outwardly from one side of the periphery of the panel member 10 and is received by another groove of an adjacent panel member (not illustrated).

As also seen in FIG. 6, a metal clip 40 is fitted on the tongue 26 extending from the top of the lower panel member 10, interposed between the lower panel member 10 and the upper panel 39. In the preferred form of the invention, the metal clip 40 is a commercially available part of approximately three inches in length. A screw 44 is shown extending through the metal clip 40 into a structural framing member 46 in the depiction of FIG. 6.

Figure 7:
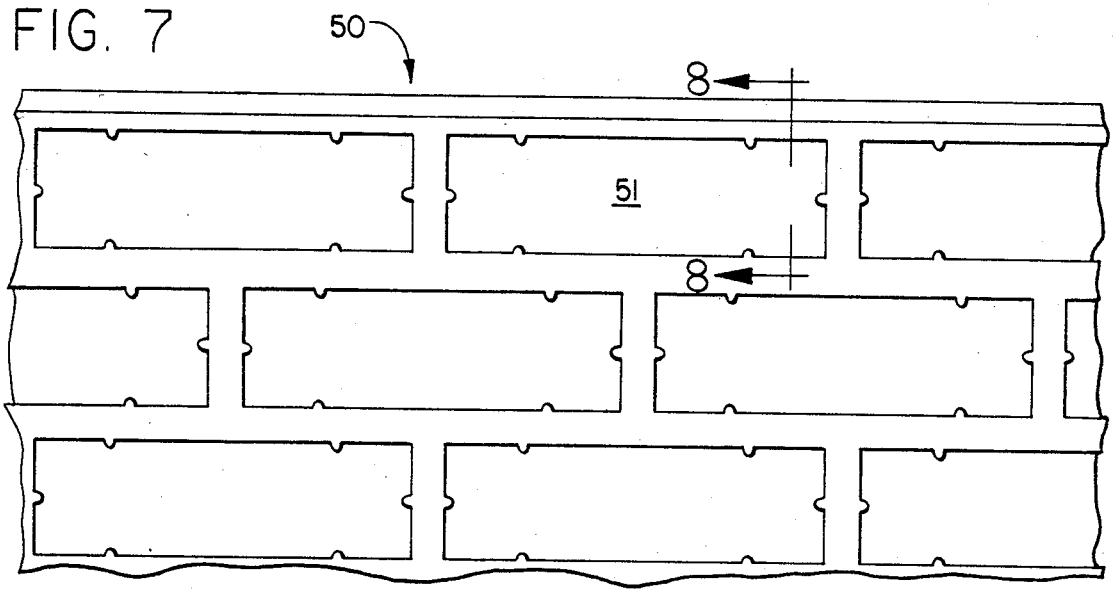
FIG. 7 is a fragmentary elevational view of a modified panel member constructed in accordance with the invention having aligned cavities adapted to receive brick facing and further having deformable ridges for forcing a friction fit with an inserted brick or other facing component.
Figure 8:
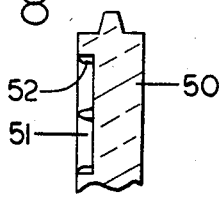
FIG. 8 is a fragmentary cross-sectional view of the panel member of FIG. 7.

FIG. 7 illustrates an alternate embodiment of the invention wherein a panel member 50 is shown with a plurality of spaced and aligned cavities 51. The spaced and aligned cavities 51 of FIG. 7 are similar to the cavities 24 of FIG. 1, except that the FIG. 7 cavities 51 have inwardly extending ridges 52 on the cavity walls. The ridges 52 are deformable under the insertion force of a facing component, such as a brick or tile, and extend inwardly beyond the dimensional clearance needed for the smallest facing component designed to be inserted thereon. In this way, even facing components 30 dimensioned with relatively low tolerances may be consistently inserted into the cavities 24 with a friction fit. The need for additional means for supplementing a facing component 30 in the cavities 24 is more prevalent when the depth of the cavity is relatively small, as in the panel member 10 depicted in FIG. 4. The deformable ridges 52 are further illustrated in the depiction of FIG. 8.

As will be readily appreciated by those skilled in the art, the above described components may be used very efficiently to erect a wall structure of brick, ceramic tile, or other facing component for as a new construction or as a sliding retrofit for an existing structure. Typically, in erecting a wall, the metal starter strip 34 is initially secured to a footer ledge 36 or other structural component. Once the metal starter strip is secured, the first of a plurality of panel members 10 is fitted over the metel starter strip 34 with the projecting tongue 34*a* of the strip 34 being received by the peripheral groove 28 of the panel member 10. The metal clip 40 is then fitted over the peripherially extending tongue 26 on the top portion of the panel member 10 and fastened to a building structural member to secure the panel member 10 in an upright position. Adjacent panel members 10 are then erected in a similar manner and interlocked with each other by inserting the peripheral tongues 26 into the respective grooves 28 in a manner well known in the art. As noted above, these panel members 10 are preferably constructed of a lightweight material, such as foamed polystyrene, and are easily and rapidly erected, particularly prior to the insertion of the facing components.

After the panel members 10 are erected, facing members 30, such as brick, may be inserted into the cavities 24 of the panel members 16. Significantly, the facing members 30 are relatively light individually and are also easily and rapidly insertable into the cavities. Moreover, the cavities 24 are precisely spaced and aligned in the panel member 30. As a result, when the facing components 30 are inserted into the cavities 24, they are arranged in the same precisely aligned and spaced relationship.

In many instances, the facing components will be friction fitted into the cavities, and it will not be necessary to provide any additional securement means to temporarily maintain the facing components in their inserted positions. This is particularly true with respect to the commercial grade panel member 10 illustrated in FIG. 4A. In this commercial grade panel member, the bottom side 24*e* of cavity 24 provides substantial support to temporarily hold the facing component in an aligned and graced position when the panel member 10 is in an upright position.

After the facing components are inserted in the cavities 24, mortor, or some other bonding agent, is then applied to the panel member in the spaces between the facing components, completely surrounding the bricks and covering the exposed portions of panel member face 12 remaining after the facing components 30 are inserted. The mortor then joins and supports the facing components, further securing the facing components in their aligned and spaced relationship.

If the friction fit between the panel member 10 and facing component is inadequate to temporarily support the facing components until the mortor dries, a double sided tape (as shown in FIG. 5), a liquid adhesive (as shown in FIG. 5*a*) or other securement technique may be used to hold the facing components in place.

It may also be desirable to secure the facing components to a building structure independently of the panel member 10. Turning back to FIG. 1, two metal wire meshes 60,62 are shown for this purpose. The wire mesh 60 is secured in spaced relationship to the panel member 10 about several of the cavities 24 and secured to studs or the like in a building structure by fastening elements 64. When mortor is applied in this space, the mortor completely surrounds the wire mesh 60. The mortor then joins the wire mesh 60 with the facing components 30 and secures these facing components 30 to the building structure independently of the panel member 10. Wire mesh member 62 extends from one panel member 10 to another, and in addition to performing the function of wire mesh 60, also joins the facing components 30 of adjacent panel members 10 independently of those panel members 10.

In summary, numerous benefits have been described which result from employing the concepts of the invention. The ability to quickly space and align facing components on a panel member makes it possible to rapidly form the wall structure at the building location without the necessity of highly skilled labor. Additionally, the panel members may be formed at a remote location and inexpensively shipped to a building location without the weight of the facing components. The facing components may then be obtained from a local source with considerable savings in shipping costs. Moreover, the erection process may be aided since the panel members may be erected without the facing components. Still further, the facing components may be inserted into the cavities in precisely aligned and spaced relationship by relatively unskilled labor. Still further, when mortor is applied to the panel member in the spaces between the facing components, the resulting facing component and mortor wall structure may be secured to a building structure independently of the panel member.

The panel members are preferably formed of a foamed polystyrene, and in addition to providing alignment and support for the facing components prior to bonding of the mortor, provides substantial thermal insulation.

The foregoing description of a preferred embodiment of the invention has been presented for purposes of illustratioon and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A building construction for erecting a wall, comprising:

(a) a wall panel member of foamed polystyrene material, said wall panel member including first and second substantially planar faces adapted for vertical disposition, said faces extending horizontally in parallel relationship between a pair of opposite end surfaces and extending vertically between top and bottom surfaces;

(b) means for securing the second planar surface of the panel member onto a building structure in an upright position with the first and second planar surfaces being in substantially parallel planes; and (c) a plurality of vertically and horizontally spaced and aligned cavities extending into the panel member for receiving a plurality of facing components, each of such cavities including at least one inwardly extending ridge deformable under the insertion force of a facing component so as to provide a friction fit for facing components of varying dimension, said cavities being spaced over substantially the entire vertical and horizontal expanse of the panel member, each of the cavities being open to the first planar surface and having top and bottom sides in substantially parallel relationship to each other and with the top and bottom surfaces of the panel member, the end surfaces of each of the cavities being in substantially parallel relationship to each other and to the end surfaces of the panel member.

2. A building construction as recited in claim 1 including at least one additional panel and further including means disposed about the periphery of said panel members for interlocking adjacent panel members in substantially co-planar relationship.

3. A building construction as recited in claim 1 wherein said cavities have five joining planar surfaces including a planar suface in substantially parallel relationship to the first planar surface and in mutually perpendicular relationship to the top, bottom and end surfaces of the cavities.

4. A building construction as recited in claim 2 wherein the means for interlocking adjacent panel members includes a tongue and groove arrangement about the periphery of each of the panel members.

5. A building construction as recited in claim 4 wherein at least one of the panel members is formed of polystyrene plastic.

6. A building construction as recited in claim 5 further including a modular facing component formed of kiln-fired brick, capable of being inserted into and supported by said cavities.

7. A building construction as recited in claim 6 wherein the modular facing component is formed of ceramic tile.

8. A building construction as recited in claim 6 wherein the cavities are approximately 8 inches in length and 2¼ inches in height.

9. A building construction as recited in claim 8 wherein the cavities are approximately 2 inches in depth.

10. A building construction as recited in claim 9 further including resilient ridges extending into said cavities, said cavities being deformable by the facing component as the facing component is inserted into the cavity for insuring a friction fit between the facing component and the panel member for facing components of slightly varying dimension.

11. A building construction as recited in claim 9 further including a double sided adhesive strip disposed between said facing component and said panel member for securing said elements together.

12. A building component as recited in claim 9 further including an adhesive disposed between said facing component and said panel member for securing said elements together.

* * * * *